US011450494B2

(12) United States Patent
Ao et al.

(10) Patent No.: US 11,450,494 B2
(45) Date of Patent: Sep. 20, 2022

(54) HANDLE OF MANUAL OPERATION MECHANISM OF CIRCUIT BREAKER

(71) Applicant: ZHEJIANG CHINT ELECTRICS CO., LTD., Zhejiang (CN)

(72) Inventors: Denggui Ao, Zhejiang (CN); Xiaoqin Yuan, Zhejiang (CN); Jinhua Xiong, Zhejiang (CN)

(73) Assignee: ZHEJIANG CHINT ELECTRICS CO., LTD.

( * ) Notice: Subject to any disclaimer, the term of this patent is extended or adjusted under 35 U.S.C. 154(b) by 0 days.

(21) Appl. No.: 17/289,788

(22) PCT Filed: Nov. 6, 2019

(86) PCT No.: PCT/CN2019/115861
§ 371 (c)(1),
(2) Date: Apr. 29, 2021

(87) PCT Pub. No.: WO2020/098536
PCT Pub. Date: May 22, 2020

(65) Prior Publication Data

US 2021/0398759 A1 Dec. 23, 2021

(30) Foreign Application Priority Data

Nov. 12, 2018 (CN) ..... 201811338386.1

(51) Int. Cl.
*H01H 21/22* (2006.01)

(52) U.S. Cl.
CPC ..... *H01H 21/22* (2013.01)

(58) Field of Classification Search
CPC ..... H01H 9/22; H01H 27/00; H01H 19/03; H01H 9/26; H01H 9/20; H01H 9/28
USPC ..... 200/335
See application file for complete search history.

(56) References Cited

U.S. PATENT DOCUMENTS 9,303,432 B2 * 4/2016 Sambar ..... E05B 1/003
2015/0221458 A1 8/2015 Oneufer et al.

FOREIGN PATENT DOCUMENTS

CN 205140837 U 4/2016
CN 205863066 U 1/2017
CN 109326469 A 2/2019
CN 209104018 U 7/2019
(Continued)

OTHER PUBLICATIONS

International Search Report dated Feb. 3, 2020 in corresponding PCT International Application No. PCT/CN2019/115861.
(Continued)

*Primary Examiner* — Edwin A. Leon
*Assistant Examiner* — Iman Malakooti
(74) *Attorney, Agent, or Firm* — Ostrolenk Faber LLP

(57) ABSTRACT

A handle of a manual operation mechanism of a circuit breaker, which includes an operating handle, a padlock device, and a locking shaft, wherein a middle of the padlock device is pivotally arranged on the operating handle, a front end of the padlock device is connected with the locking shaft, the padlock device is connected with the operating handle through a first driving member, a rear end of the padlock device is in limit fit with a locking mechanism, a padlock hole is arranged in the rear end of the padlock device, and the padlock hole is shielded by the operating handle.

16 Claims, 6 Drawing Sheets

(56) References Cited

FOREIGN PATENT DOCUMENTS

| | | | | | |
|---|---|---|---|---|---|
| CN | 209232622 | U | | 8/2019 | |
| FR | 3 029 680 | A1 | | 6/2016 | |
| FR | 3029680 | | * | 6/2016 | ..... H01H 9/28 |

OTHER PUBLICATIONS

Written Opinion dated Feb. 3, 2020 in corresponding PCT International Application No. PCT/CN2019/115861.

* cited by examiner

HANDLE OF MANUAL OPERATION MECHANISM OF CIRCUIT BREAKER

CROSS-REFERENCE TO RELATED APPLICATIONS

The present application is a 35 U.S.C. §§ 371 national phase conversion of International Application No. PCT/CN2019/115861, filed Nov. 6, 2019, which claims priority to Chinese Patent Application No. 201811338386.1, filed Nov. 12, 2018, the contents of both of which are incorporated herein by reference. The PCT International Application was published in the Chinese language.

TECHNICAL FIELD

The present invention relates to the field of low-voltage electric appliances, and more particularly, to a handle of a manual operation mechanism of a circuit breaker.

BACKGROUND ART

According to an existing handle of a manual operation mechanism of a circuit breaker, a padlock device thereof often has a phenomenon that an action location is not in place, and the circuit breaker can still be operated to switch off and on after being locked, thus losing a protection function. Chinese patent CN205140837U discloses a handle of a manual operation mechanism of a circuit breaker, which is provided with a padlock device, but does not have a locking shaft for locking the padlock device. The user needs to maintain the position of the padlock device when operating the operating handle, which is inconvenient to operate. Moreover, after the padlock is installed, due to the inevitable gap between the padlock and the padlock hole, the reset spring will slightly pull down the rear end of the padlock device, causing the front end of the padlock device to move up slightly, causing the padlock device to be locked out of place, and the circuit breaker can still be operated.

SUMMARY OF THE INVENTION

The present invention aims to overcome the defects in the prior art, and provides a handle of a manual operation mechanism of a circuit breaker, the padlock device can be locked by the locking mechanism, so that a user rotates the operating handle conveniently, and after the circuit breaker is switched off/switched on to unlock the locking mechanism, the padlock device can automatically drive the locking shaft to lock the operating handle.

In order to achieve the above objective, the technical solutions used in the present invention are as follows.

A handle of a manual operation mechanism of a circuit breaker, comprising an operating handle 15, a padlock device 12, and a locking shaft 14, a middle of the padlock device 12 is pivotally arranged on the operating handle 15, a front end of the padlock device 12 is connected with the locking shaft 14, the padlock device 12 is connected with the operating handle 15 through a first driving member, a rear end of the padlock device 12 is in limit fit with a locking mechanism, a padlock hole 21 is arranged in the rear end of the padlock device 12, and the padlock hole 21 is shielded by the operating handle 15;

when the circuit breaker is in a switch-off state, the locking mechanism is unlocked, the first driving member makes the front end of the padlock device 12 sink to drive the locking shaft 14 to lock the operating handle 15, and meanwhile, the rear end of the padlock device 12 is raised up to expose the padlock hole 21 from an inside of the operating handle 15.

Preferably, the first driving member is a spring 13, one end of the spring 13 is connected with the padlock device 12, and the other end of the spring is connected with the operating handle 15.

Preferably, the middle of the padlock device 12 is pivotally arranged on the operating handle 15 through a first pivot 30; and the first driving member is a torsion spring 40, the torsion spring 40 is sleeved on the first pivot 30, one end of the torsion spring is connected with the padlock device 12 and the other end of the torsion spring is connected with the operating handle 15.

Preferably, the locking mechanism comprises a locking member 20, a rear-end torsion spring 25, and an operating button 19, a middle of the locking member 20 is pivotally arranged on the operating handle 15 through a second pivot 23, the rear-end torsion spring 25 is sleeved on the second pivot 23, one end of the rear-end torsion spring is connected with the operating handle 15, the other end of the rear-end torsion spring is connected with the locking member 20, one end of the locking member 20 is in limit fit with the rear end of the padlock device 12, the other end of the locking member fits with the operating button 19, and when the operating button is pressed, the locking member 20 releases the rear end of the padlock device 12, the front end of the padlock device 12 sinks, and the rear end of the padlock device is raised up.

Preferably, the locking member 20 comprises a locking member main body 202, a locking member pressing plate 200, and a locking member hook 203, the locking member main body 202 is pivotally arranged on the operating handle 15 through the second pivot 23, the locking member pressing plate 200 fits with the operating button 19, and the locking member hook 203 is in limit fit with the rear end of the padlock device 12.

Preferably, the locking member hook 203 and the locking member pressing plate 200 are respectively arranged at two ends of the locking member main body 202, so that the locking member 20 has a V-shaped structure as a whole.

Preferably, the padlock device 12 is a rod-shaped member, which comprises a first clamping groove 121 arranged at the front end of the padlock device 12, one end of the locking shaft 14 is provided with a locking shaft slot, a locking shaft cross bar 141 is arranged in the locking shaft slot, and the locking shaft cross bar 141 is clamped in the first clamping groove 121 and is in sliding fit with the first clamping groove.

Preferably, the rear end of the padlock device 12 is provided with a first locking groove 120 in limit fit with the locking member hook 203.

Preferably, the middle of the padlock device 12 is pivotally arrange on the operating handle 15 through a first pivot 30, the padlock device 12 comprises a first spring hanging hole 123, and the first spring hanging hole 123 is arranged between a first clamping groove 121 of the padlock device 12 and the first pivot 30; and a second spring hanging hole 152 is arranged in the operating handle 15, one end of the spring 13 is connected with the first spring hanging hole 123, and the other end of the spring is connected with the second spring hanging hole 152.

Preferably, the operating handle 15 comprises a first fixing plate 154 arranged thereon and a first convex column 153 arranged on the first fixing plate 154; and the padlock device 12 comprises a second convex column 122 arranged thereon, the second convex column 122 is located between the first clamping groove 121 of the padlock device 12 and the first pivot 30, one end of the torsion spring 40 is connected with the first convex column 153, and the other end of the torsion spring is connected with the second convex column 122.

Preferably, the padlock device 12 is a rod-shaped member, which comprises a first ridge plate 129, a second ridge plate 128, a first web plate 126, a second web plate 125, a first clamping groove 121, the padlock hole 21, a shaft plate 127, and a first locking groove 120, the shaft plate 127 is pivotally arranged on the operating handle 15 through a first pivot 30, the first ridge plate 129, the shaft plate 127, and the second ridge plate 128 are sequentially connected, the first web plate 126 is arranged on one side of the first ridge plate 129 and the first web plate 126 is respectively connected with the first ridge plate 129 and the shaft plate 127, the second web plate 125 is arranged on one side of the second ridge plate 128 and the second web plate 125 is respectively connected with the second ridge plate 128 and the shaft plate 127, the first web plate 126 and the second web plate 125 are respectively located on two sides of the shaft plate 127, the first web plate 126 and the second web plate 125 are located on a same side of the first ridge plate 129, the first clamping groove 121 is arranged at one end of the second web plate 125 far away from the shaft plate 127, the padlock hole 21 is arranged in a middle of the first web plate 126, and the first locking groove 120 is arranged at one end of the first web plate 126 far away from the shaft plate 127.

Preferably, the padlock device 12 further comprises a first spring hanging hole 123 arranged in the second web plate 125, and the first spring hanging hole 123 is arranged between the first clamping groove 121 and the shaft plate 127.

Preferably, the padlock device 12 further comprises a second convex column 122 arranged on the second web plate 125, and the second convex column 122 is arranged between the first clamping groove 121 and the shaft plate 127.

Preferably, the operating handle 15 comprises a first fixing plate 154, a locking shaft sliding hole 150, and a locking mechanism assembly hole 151, two first fixing plates 154 are arranged on the operating handle 15 in parallel at an interval, the locking shaft sliding hole 150 is arranged outside one end of the first fixing plate 154, and the locking mechanism assembly hole 151 is arranged outside the other end of the first fixing plate 154.

Preferably, the operating handle 15 further comprises a second spring hanging hole 152, and the second spring hanging hole 152 is arranged between the locking shaft sliding hole 150 and the first fixing plate 154.

Preferably, the operating handle 15 further comprises a first convex column 153, and the first convex column 153 is arranged on one side of the first fixing plate 154.

According to a handle of a manual operation mechanism of a circuit breaker of the present invention, when the circuit breaker is in a switch-off state, a locking mechanism is unlocked, a first driving member makes a front end of a padlock device sink, the padlock device drives a locking shaft to automatically lock an operating handle, so that the operating handle cannot rotate continuously, thus being beneficial for improving a safety of using electricity, and a padlock hole in a rear end of the padlock device is exposed from an inside of the operating handle, and is used for padlocking the padlock device; and the locking mechanism may keep the padlock device in a locked state, and a user may freely operate the operating handle without pressing the padlock device while operating, thus simplifying the operation.

DETAILED DESCRIPTION OF THE PREFERRED EMBODIMENTS

The specific implementations of a handle of a manual operation mechanism of a circuit breaker of the present invention are further described hereinafter with reference to the embodiments shown in FIG. 1 to FIG. 8. The handle of the manual operation mechanism of the circuit breaker of the present invention is not limited to the descriptions in the following embodiments.

A handle of a manual operation mechanism of a circuit breaker in the present invention, comprises an operating handle 15, a padlock device 12, and a locking shaft 14, wherein a middle of the padlock device 12 is pivotally arranged on the operating handle 15, a front end of the padlock device 12 is connected with the locking shaft 14, the padlock device 12 is connected with the operating handle 15 through a first driving member, a rear end of the padlock device 12 is in limit fit with a locking mechanism, a padlock hole 21 is arranged in the rear end of the padlock device 12, and the padlock hole 21 is shielded by the operating handle 15;

when the circuit breaker is in a switch-off state, the locking mechanism is unlocked, the first driving member makes the front end of the padlock device 12 sink to drive the locking shaft 14 to lock the operating handle 15, and meanwhile, the rear end of the padlock device 12 is raised up to expose the padlock hole 21 from an inside of the operating handle 15.

According to a handle of a manual operation mechanism of a circuit breaker of the present invention, when the circuit breaker is in a switch-off state, a locking mechanism is unlocked, a first driving member makes a front end of a padlock device 12 sink, the padlock device 12 drives a locking shaft 14 to automatically lock an operating handle 15, so that the operating handle 15 cannot rotate continuously, thus being beneficial for improving a safety of using electricity, and a padlock hole 21 in a rear end of the padlock device 12 is exposed from an inside of the operating handle 15, and is used for padlocking the padlock device 12; and the locking mechanism may keep the padlock device in a locked state, and a user may freely operate the operating handle 15 without pressing the padlock device 12 while operating, thus simplifying the operation.

Figure 1:
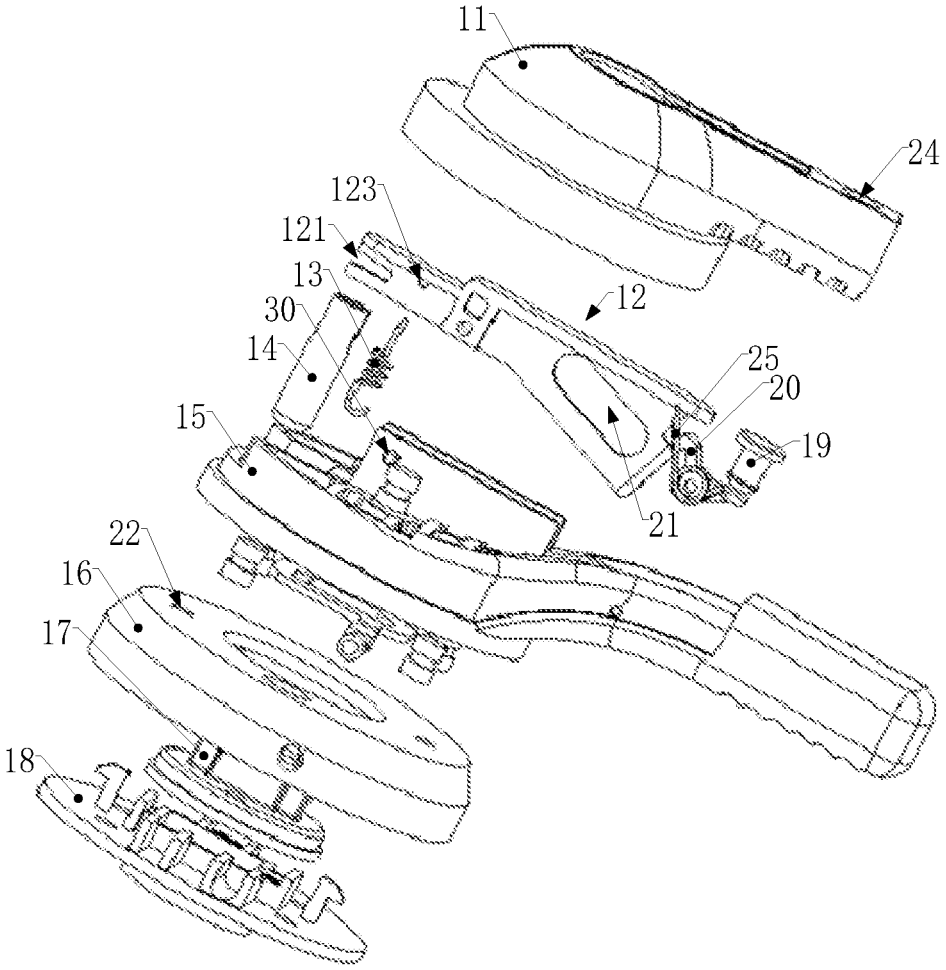
FIG. 1 is a schematic structural diagram of a handle of a manual operation mechanism of a circuit breaker of the present invention.
Figure 2:
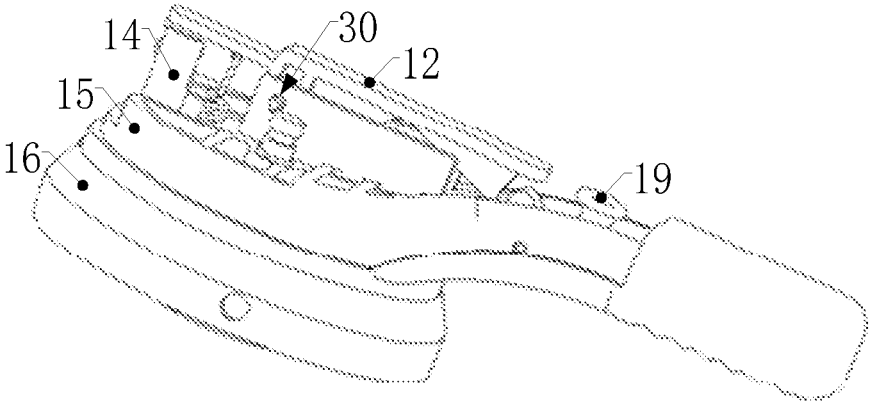
FIG. 2 is a schematic structural diagram of assembly of a padlock device and an operating handle of the present invention.

FIG. 1 and FIG. 2 show an embodiment of the handle of the manual operation mechanism of the circuit breaker of the present invention.

The handle of the manual operation mechanism of the circuit breaker of the present invention fits with a circuit breaker handle of the circuit breaker to switch off/on the circuit breaker.

As shown in FIG. 1 and FIG. 2, the handle of the manual operation mechanism of the circuit breaker includes an operating handle 15, a padlock device 12, and a locking shaft 14. A middle of the padlock device 12 is pivotally arranged on the operating handle 15, a front end of the padlock device 12 is connected with the locking shaft 14, the padlock device 12 is connected with the operating handle 15 through a first driving member, a rear end of the padlock device 12 fits with a locking mechanism, a padlock hole 21 is arranged in the rear end of the padlock device 12, and the padlock hole 21 is shielded by the operating handle 15. When the circuit breaker is in a switch-off state, the locking mechanism is unlocked, the first driving member makes the front end of the padlock device 12 sink, and the padlock device 12 drives the locking shaft 14 to lock the operating handle. Meanwhile, the rear end of the padlock device 12 is raised up to expose the padlock hole 21 from an inside of the operating handle 15. It should be pointed out that "when the circuit breaker is in a switch-off state" in the above content refers to a condition when the circuit breaker is converted to a switch-off state by rotating the operating handle 15.

Specifically, in a direction shown in FIG. 1, the padlock device 12 is arranged on an upper side of the operating handle 15, and the middle of the padlock device 12 is pivotally arranged on the operating handle 15 through a first pivot 30. A left end of the padlock device 12 is connected with the locking shaft 14, a right end of the padlock device 12 is in limited fit with the locking mechanism, and the padlock hole 21 is arranged in the right end of the padlock device 12.

Preferably, the padlock hole 21 is an elongated hole capable of accommodating at least three locks at the same time.

Figure 3:
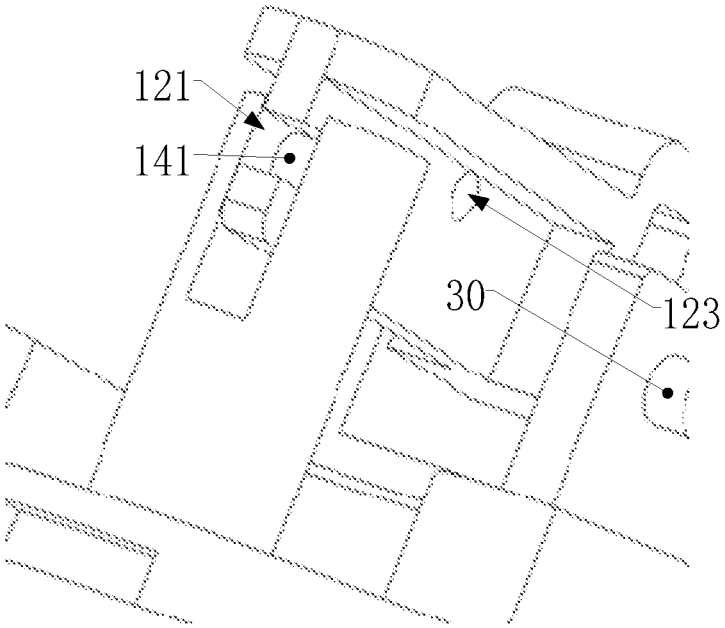
FIG. 3 is a schematic structural diagram of assembly of the padlock device and a locking shaft of the present invention.

Preferably, in a direction shown in FIG. 1 and FIG. 3, the left end of the padlock device 12 is provided with a first clamping groove 121. In a direction shown in FIG. 3, an upper end of the locking shaft 14 is provided with a locking shaft slot, a locking shaft cross bar 141 is arranged in the locking shaft slot, and the locking shaft cross bar 141 is clamped in the first clamping groove 121 and is in sliding fit with the first clamping groove. Further, the first clamping groove 121 is an elongated groove, and when the locking shaft 14 moves up and down, the locking shaft cross bar 141 slides in the first clamping groove 121.

Preferably, in a direction shown in FIG. 1, the first driving member is a spring 13, the right end of the padlock device 12 is provided with a first spring hanging hole 123, and the first spring hanging hole 123 is arranged between the first clamping groove 121 and the first pivot 30. In a direction shown in FIG. 6, the operating handle 15 includes a second hanging spring hole 152 arranged thereon, and the second hanging spring hole 152 is located below the padlock device 12. An upper end of the spring 13 is connected with the first hanging spring hole 123, and a lower end of the spring 13 is connected with the second hanging spring hole 152.

Figure 7:
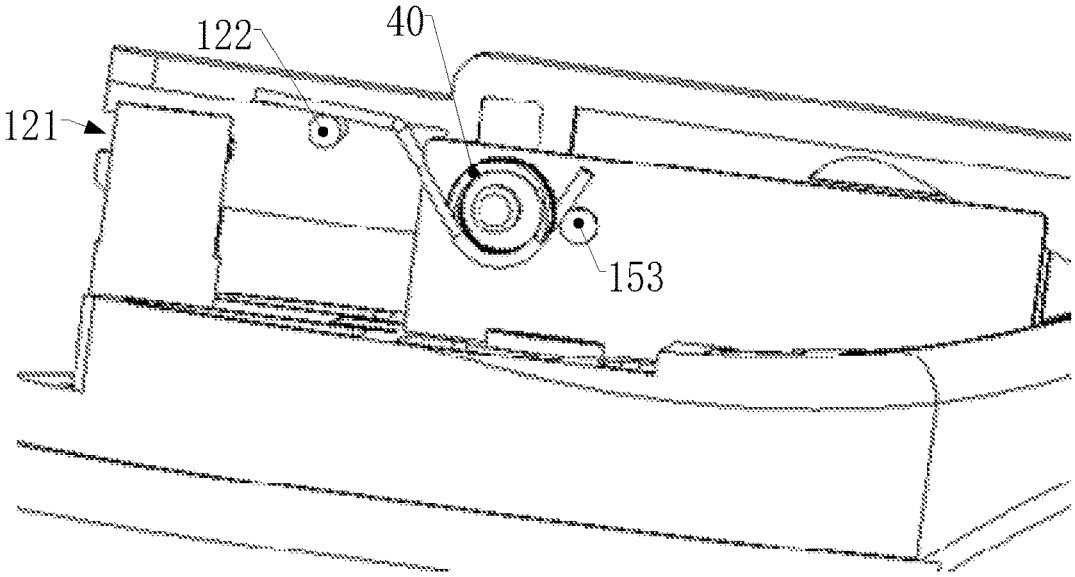
FIG. 7 is a schematic structural diagram of assembly of the padlock device, a torsion spring, and the operating handle of the present invention.

Preferably, in a direction shown in FIG. 7, the first driving member is a torsion spring 40, and the torsion spring 40 is sleeved on the first pivot 30. The padlock device 12 includes a second convex column 122 arranged thereon, and the second convex column 122 is located between the first clamping groove 121 and the first pivot 30. The operating handle 15 includes a first convex column 153, and the first convex column 153 is arranged on a first fixing plate 154 and is located on one side of the first pivot 30. A left end of the torsion spring 40 is connected with the first convex column 153, and a right end of the torsion spring is connected with the second convex column 122.

Figure 5:
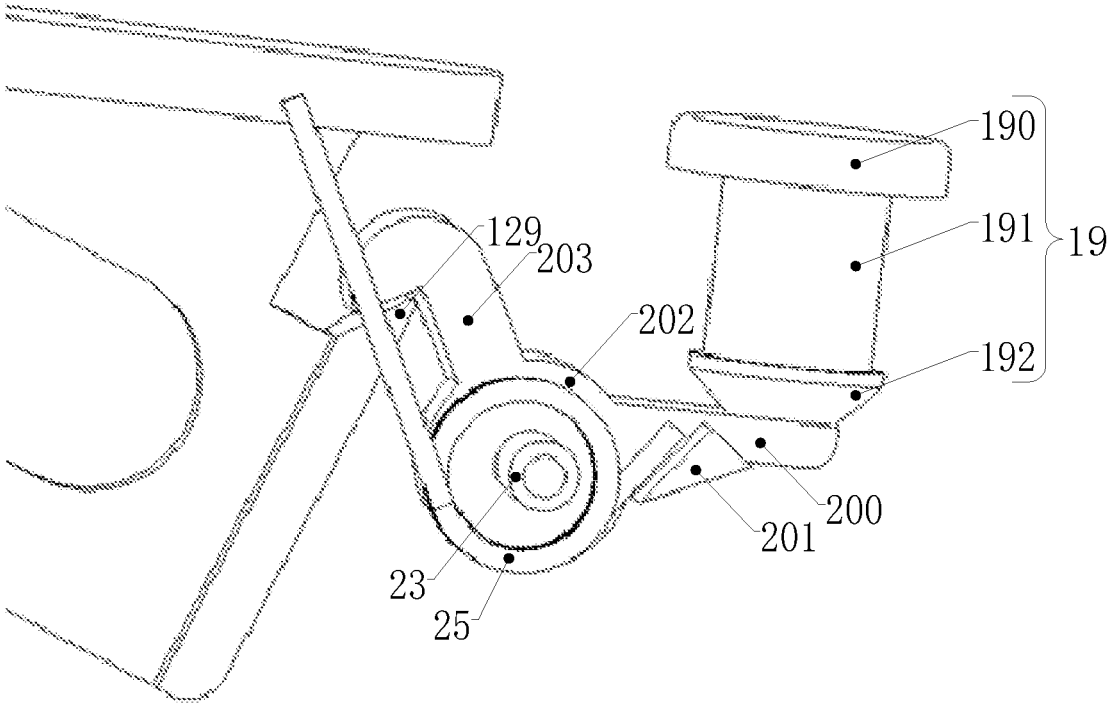
FIG. 5 is a schematic structural diagram of assembly of the button, the lock catch, and the padlock device of the present invention.
Figure 6:
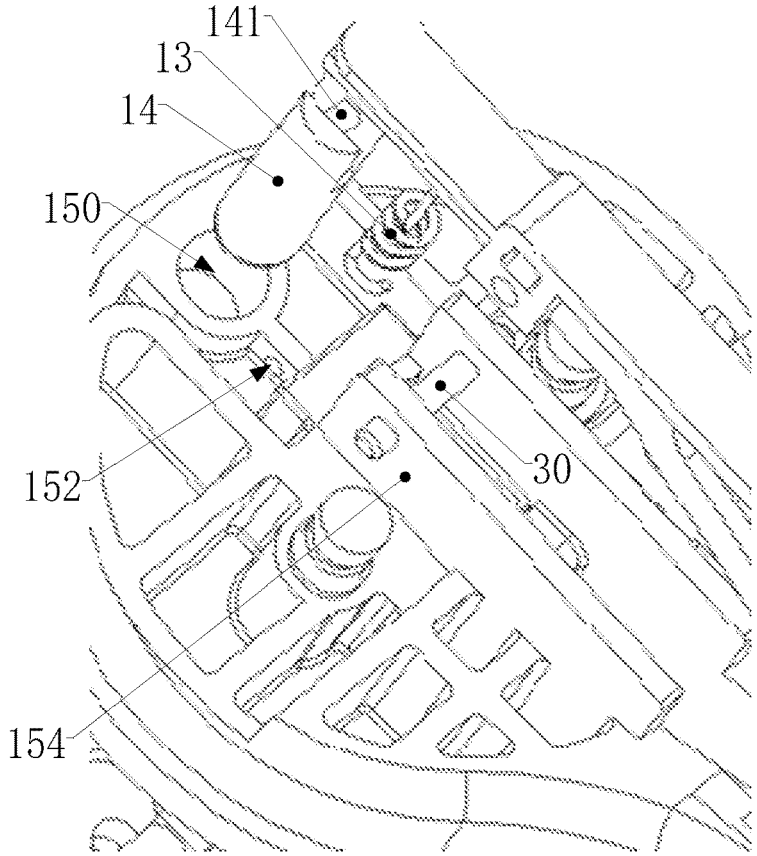
FIG. 6 is a schematic structural diagram of assembly of the padlock device, a spring, and the operating handle of the present invention.

Preferably, as shown in FIG. 1 and FIG. 5, the locking mechanism includes a locking member 20, a rear-end torsion spring 25, and an operating button 19. The locking member 20 is pivotally arranged on the operating handle 15 through a second pivot 23, one end of the locking member 20 is in limit fit with the rear end of the padlock device 12, and the other end of the locking member is in driving fit with the operating button 19. The rear-end torsion spring 25 is sleeved on the second pivot 23, one end of the rear-end torsion spring is connected with the operating handle 15, and the other end of the rear-end torsion spring is connected with the locking member 20.

Preferably, as shown in FIG. 1, The handle of the manual operation mechanism of the circuit breaker of the present invention further includes a handle shell 11, an upper cover 16, a shaft sleeve 17, and a lower cover 18. The handle shell 11 is fixedly connected with the operating handle 15, the padlock device 12 is arranged on an upper side of the operating handle 15 and is located in a space formed by the handle shell 11 and the operating handle 15. The upper cover 16 and the lower cover 18 are sequentially arranged on a lower side of the operating handle 15, and the shaft sleeve 17 is assembled between the upper cover 16 and the lower cover 18, and fits with the operating handle 15.

Certainly, the handle of the manual operation mechanism of the circuit breaker of the present invention further includes other necessary components to transmit an action of the operating handle 15 to the circuit breaker handle of the circuit breaker to switch off/on the circuit breaker.

Figure 8:
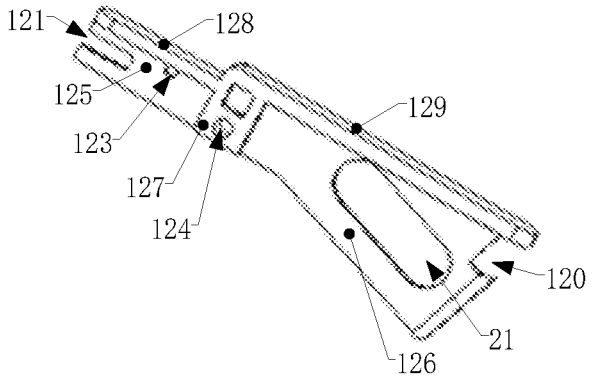
FIG. 8 is a schematic structural diagram of the padlock device of the present invention.

FIG. 8 shows an embodiment of the padlock device 12 of the present invention.

In a direction shown in FIG. 8, the padlock device 12 is a rod-shaped member, which includes a first ridge plate 129, a second ridge plate 128, a first web plate 126, a second web plate 125, a first clamping groove 121, the padlock hole 21, a shaft plate 127, and a first locking groove 120. The shaft plate 127 is pivotally arranged on the operating handle 15 through a first pivot 30, the first ridge plate 129, the shaft plate 127, and the second ridge plate 128 are sequentially connected, the first web plate 126 is arranged on a lower side of the first ridge plate 129, and the first web plate 126 is respectively connected with the first ridge plate 129 and the shaft plate 127. The second web plate 125 is arranged on a lower side of the second ridge plate 128, and the second web plate 125 is respectively connected with the second ridge plate 128 and the shaft plate 127. The first web plate 126 and the second web plate 125 are respectively located on two sides of the shaft plate 127, and the first web plate 126 and the second web plate 125 are both located on a lower side of the first ridge plate 129. The first clamping groove 121 is arranged at one end of the second web plate 125 far away from the shaft plate 127 (which means that the first clamping groove 121 is arranged at a left end of the second web plate 125), the padlock hole 21 is arranged in a middle of the first web plate 126, and the first locking groove 120 is arranged at one end of the first web plate 126 far away from the shaft plate 127 (which means that the first locking groove 120 is arranged at a right end of the first web plate 126).

Preferably, the padlock device 12 further includes a first spring hanging hole 123 arranged in the second web plate 125, and the first spring hanging hole 123 is arranged between the first clamping groove 121 and the shaft plate 127.

Preferably, the first web plate 126 and the second web plate 125 have a same thickness, a thickness of the shaft plate 127 is greater than that of the first web plate 126, and a first shaft hole 124 fitting with the first pivot 30 is arranged in the shaft plate 127. A thickened design is adopted in the shaft plate 27, which can prolong a service life of the padlock device 12.

Preferably, the first ridge plate 129 and the second ridge plate 128 are staggered, an upper side face of the first ridge plate 129 is flush with an upper end of the shaft plate 27, and the second ridge plate 128 is connected with a middle of the shaft plate 27.

FIG. 7 shows another embodiment of the padlock device 12 of the present invention, which is different from the above embodiment in that: the padlock device 12 of the embodiment is not provided with the first spring hanging hole 123. The padlock device 12 of the embodiment includes a second convex column 122 arranged on the second web plate 125, and the second convex column 122 is arranged between the first clamping groove 121 and the first pivot 30.

FIG. 5 shows an embodiment of the locking mechanism of the present invention.

As shown in FIG. 5, the locking mechanism includes a locking member 20, a rear-end torsion spring 25, and an operating button 19. A middle of the locking member 20 is pivotally arranged on the operating handle 15 through a second pivot 23, and the rear-end torsion spring 25 is sleeved on the second pivot 23. One end of the rear-end torsion spring is connected with the operating handle 15, and the other end of the rear-end torsion spring is connected with the locking member 20. One end of the locking member 20 is in limit fit with the rear end of the padlock device 12, and the other end of the locking member fits with the operating button 19.

Preferably, the locking member 20 includes a locking member main body 202, a locking member pressing plate 200, and a locking member hook 203. The locking member main body 202 is pivotally arranged on the operating handle 15 through the second pivot 23, the locking member pressing plate 200 fits with the operating button 19 (the operation button 19 is arranged on an upper side of the locking member pressing plate 200), and the locking member hook 203 is in limit fit with the first locking groove 120 of the padlock device 12.

Preferably, the locking member hook 200 and the locking member pressing plate 203 are respectively arranged at two ends of the locking member main body 202, so that the locking member 20 has a V-shaped structure as a whole.

Preferably, one side of the locking member pressing plate 200 is provided with a first boss 201, one end of the rear-end torsion spring 25 is in limit fit with the first boss 201, and the other end of the rear-end torsion spring is in limit fit with the operating handle 15.

Preferably, the operating button 19 includes an operating button head 190, an operating button body 191, and an operating button foot 192 which are sequentially connected. The operating button foot 192 is arranged on an upper side of the locking member pressing plate 200, and the operating button 19 is inserted on the operating handle 15, and is in sliding fit with the operating handle.

Figure 4:
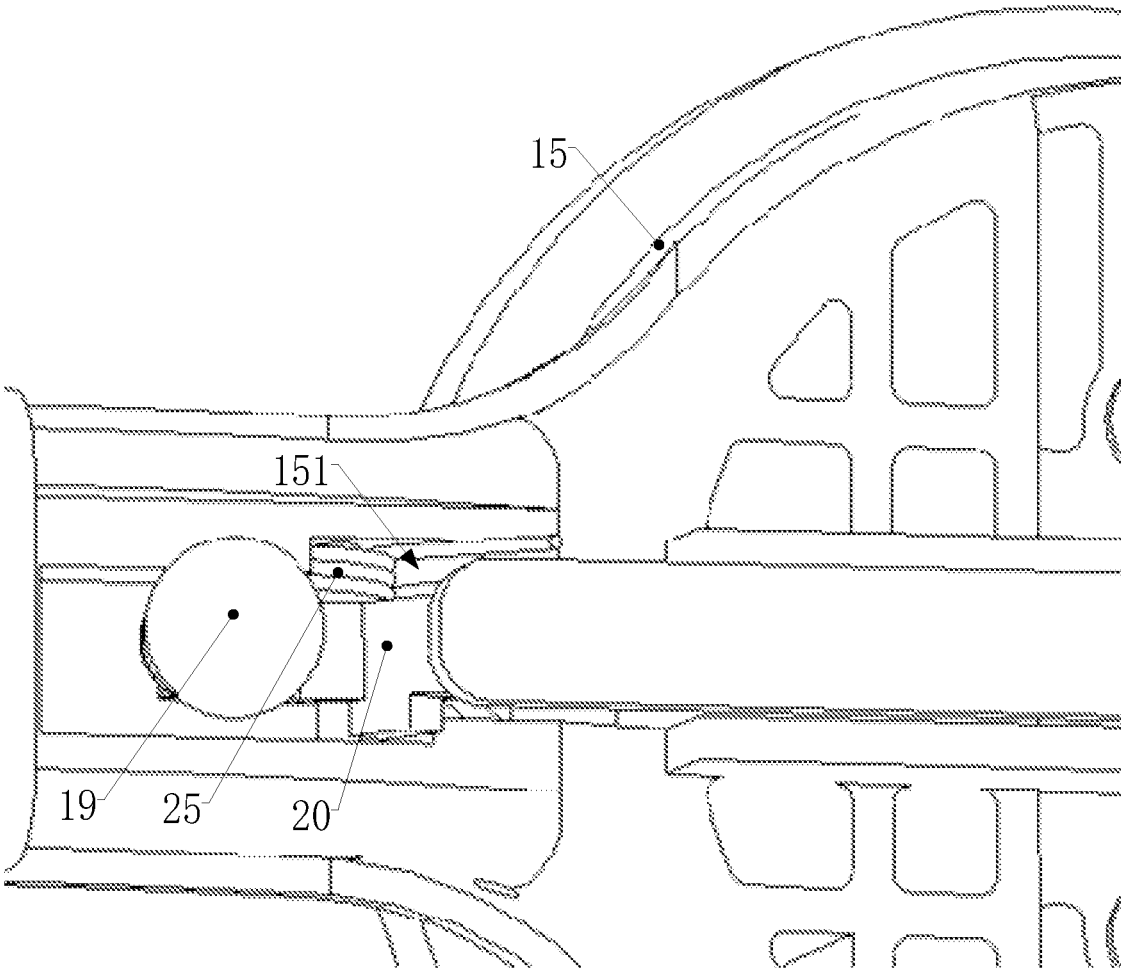
FIG. 4 is a schematic structural diagram of assembly of a button, a lock catch, the padlock device, and the operating handle of the present invention.

FIG. 1 and FIG. 4 show an embodiment of the operating handle 15 of the present invention.

As shown in FIG. 1 and FIG. 4, the operating handle 15 includes a first fixing plate 154, a locking shaft sliding hole 150, a second hanging spring hole 152, and a locking mechanism assembly hole 151 arranged thereon. Two first fixing plates 154 are arranged on the upper side of the operating handle 15 in parallel at an interval, the shaft plate 127 of the padlock device 12 is arranged between the two first fixing plates 154, and the first pivot 30 passes through the shaft plate 127 and the first fixing plate 154 to connect the padlock device 12 and the operating handle 15 together. The locking shaft sliding hole 150 is arranged outside one end of the first fixing plate 154, the locking shaft 14 is inserted into the locking shaft sliding hole 150 and is in sliding fit with the locking shaft sliding hole, and the second hanging spring hole 152 is arranged between the first fixing plate 154 and the locking shaft sliding hole 150. One end of the spring 13 is connected with the first hanging spring hole 123 of the padlock device 12, and the other end of the spring is connected with the second hanging spring hole 152. The locking mechanism assembly hole 151 is arranged outside the other end of the first fixing plate 154, the locking member 20 of the locking mechanism is arranged in the locking mechanism assembly hole 151 through the second pivot 23, and the rear-end torsion spring 25 of the locking mechanism is sleeved on the second pivot 23. One end of the rear-end torsion spring is in limit fit with a hole wall of the locking mechanism assembly hole 151, and the other end of the rear-end torsion spring is in limit fit with the first boss 201 of the locking member 20.

Preferably, as shown in FIG. 2, the shaft plate 127 and the first web plate 126 of the padlock device 12 are both arranged between the two first fixing plates 154, and the padlock hole 21 in the first web plate 126 is shielded by the two first fixing plates 154.

FIG. 7 shows another embodiment of the operating handle 15 of the present invention.

The operating handle 15 of the embodiment is different from the above embodiment in that: the operating handle 15 is not provided with the second hanging spring hole 152, the first convex column 153 is arranged on the first fixing plate 154 of the operating handle 15, and the torsion spring 40 is sleeved on the first pivot 30. One end of the torsion spring 40 is in limit fit with the first convex column 153, and the other end of the torsion spring is in limit fit with the second convex column 122.

The above is the further detailed descriptions of the present invention with reference to the specific preferred implementations, and the specific implementations of the present invention cannot be considered as being limited to these descriptions. Those of ordinary skills in the art of the present invention may further make several simple deductions or substitutions without departing from the concept of the present invention, and these deductions or substitutions should be regarded as belonging to the scope of protection of the present invention.

The invention claimed is:

1. A handle of a manual operation mechanism of a circuit breaker, comprising:

an operating handle, a padlock device, and a locking shaft, and a locking mechanism, wherein a middle of the padlock device is pivotally arranged on the operating handle, a front end of the padlock device is connected with the locking shaft, the padlock device is connected with the operating handle through a first driving member, a rear end of the padlock device is in limit fit with the locking mechanism, a padlock hole is arranged in the rear end of the padlock device, wherein when the locking mechanism locks the padlock device, the padlock hole is shielded by the operating handle, and the padlock device enables the first drive member to store energy, and wherein when the circuit breaker is in a switch-off state, the locking mechanism is unlocked, the first driving member makes the front end of the padlock device sink to drive the locking shaft to lock the operating handle, and meanwhile, the rear end of the padlock device is raised up to expose the padlock hole from an inside of the operating handle.

2. The handle of the manual operation mechanism of the circuit breaker according to claim 1, wherein the first driving member is a spring, one end of the spring is connected with the padlock device, and the other end of the spring is connected with the operating handle.

3. The handle of the manual operation mechanism of the circuit breaker according to claim 1, wherein the middle of the padlock device is pivotally arranged on the operating handle through a first pivot; and the first driving member is a torsion spring, the torsion spring is sleeved on the first pivot, one end of the torsion spring is connected with the padlock device and the other end of the torsion spring is connected with the operating handle.

4. The handle of the manual operation mechanism of the circuit breaker according to claim 1, wherein the locking mechanism comprises a locking member, a rear-end torsion spring, and an operating button, a middle of the locking member is pivotally arranged on the operating handle through a second pivot, the rear-end torsion spring is sleeved on the second pivot, one end of the rear-end torsion spring is connected with the operating handle, the other end of the rear-end torsion spring is connected with the locking member, one end of the locking member is in limit fit with the rear end of the padlock device, the other end of the locking member fits with the operating button, and when the operating button is pressed, the locking member releases the rear end of the padlock device, the front end of the padlock device sinks, and the rear end of the padlock device is raised up.

5. The handle of the manual operation mechanism of the circuit breaker according to claim 4, wherein the locking member comprises a locking member main body, a locking member pressing plate, and a locking member hook, the locking member main body is pivotally arranged on the operating handle through the second pivot, the locking member pressing plate fits with the operating button, and the locking member hook is in limit fit with the rear end of the padlock device.

6. The handle of the manual operation mechanism of the circuit breaker according to claim 5, wherein the locking member hook and the locking member pressing plate are respectively arranged at two ends of the locking member main body, so that the locking member has a V-shaped structure as a whole.

7. The handle of the manual operation mechanism of the circuit breaker according to claim 1, wherein the padlock device is a rod-shaped member, which comprises a first clamping groove arranged at the front end of the padlock device, one end of the locking shaft is provided with a locking shaft slot, a locking shaft cross bar is arranged in the locking shaft slot, and the locking shaft cross bar is clamped in the first clamping groove and is in sliding fit with the first clamping groove.

8. The handle of the manual operation mechanism of the circuit breaker according to claim 5, wherein the rear end of the padlock device is provided with a first locking groove in limit fit with the locking member hook.

9. The handle of the manual operation mechanism of the circuit breaker according to claim 2, wherein the middle of the padlock device is pivotally arranged on the operating handle through a first pivot, the padlock device comprises a first spring hanging hole, and the first spring hanging hole is arranged between a first clamping groove of the padlock device and the first pivot; and a second spring hanging hole is arranged in the operating handle, one end of the spring is connected with the first spring hanging hole, and the other end of the spring is connected with the second spring hanging hole.

10. The handle of the manual operation mechanism of the circuit breaker according to claim 3, wherein the operating handle comprises a first fixing plate arranged thereon and a first convex column arranged on the first fixing plate; and the padlock device comprises a second convex column arranged thereon, the second convex column is located between the first clamping groove of the padlock device and the first pivot, one end of the torsion spring is connected with the first convex column, and the other end of the torsion spring is connected with the second convex column.

11. The handle of the manual operation mechanism of the circuit breaker according to claim 1, wherein the padlock device is a rod-shaped member, which comprises a first ridge plate, a second ridge plate, a first web plate, a second web plate, a first clamping groove, the padlock hole, a shaft plate, and a first locking groove, the shaft plate is pivotally arranged on the operating handle through a first pivot, the first ridge plate, the shaft plate, and the second ridge plate are sequentially connected, the first web plate is arranged on one side of the first ridge plate and the first web plate is respectively connected with the first ridge plate and the shaft plate, the second web plate is arranged on one side of the second ridge plate and the second web plate is respectively connected with the second ridge plate and the shaft plate, the first web plate and the second web plate are respectively located on two sides of the shaft plate, the first web plate and the second web plate are located on a same side of the first ridge plate, the first clamping groove is arranged at one end of the second web plate far away from the shaft plate, the padlock hole is arranged in a middle of the first web plate, and the first locking groove is arranged at one end of the first web plate far away from the shaft plate.

12. The handle of the manual operation mechanism of the circuit breaker according to claim 11, wherein the padlock device further comprises a first spring hanging hole arranged in the second web plate, and the first spring hanging hole is arranged between the first clamping groove and the shaft plate.

13. The handle of the manual operation mechanism of the circuit breaker according to claim 11, wherein the padlock device further comprises a second convex column arranged on the second web plate, and the second convex column is arranged between the first clamping groove and the shaft plate.

14. The handle of the manual operation mechanism of the circuit breaker according to claim 1, wherein the operating handle comprises a first fixing plate, a locking shaft sliding hole, and a locking mechanism assembly hole, the locking shaft sliding hole is arranged outside one end of the first fixing plate, and the locking mechanism assembly hole is arranged outside the other end of the first fixing plate.

15. The handle of the manual operation mechanism of the circuit breaker according to claim 14, wherein the operating handle further comprises a second spring hanging hole, and the second spring hanging hole is arranged between the locking shaft sliding hole and the first fixing plate.

16. The handle of the manual operation mechanism of the circuit breaker according to claim 14, wherein the operating handle further comprises a first convex column, and the first convex column is arranged on one side of the first fixing plate.

* * * * *